US006297514B1

(12) United States Patent
Cortes et al.

(10) Patent No.: US 6,297,514 B1
(45) Date of Patent: Oct. 2, 2001

(54) INSTALLATION FOR THE QUALITY CONTROL OF YARN BOBBINS

(75) Inventors: Albert Sanfeliu Cortes, Barcelona Brusi; Antoni Llorens Castello, Barcelona Passeig Sant Gervasi, both of (ES)

(73) Assignee: Cognivision Research, S.L. (ES)

( * ) Notice: Subject to any disclaimer, the term of this patent is extended or adjusted under 35 U.S.C. 154(b) by 0 days.

(21) Appl. No.: 09/386,004

(22) Filed: Aug. 30, 1999

Related U.S. Application Data

(63) Continuation of application No. PCT/ES97/00317, filed on Dec. 30, 1997.

(51) Int. Cl.[7] ..... G01N 21/88

(52) U.S. Cl. ..... 250/559.45; 250/223 R; 250/239; 356/238.2; 209/538

(58) Field of Search ..... 250/239, 223 R, 250/559.45; 356/238.2; 209/538

(56) References Cited

U.S. PATENT DOCUMENTS 4,730,733 * 3/1988 Kawamura et al. ..... 209/538
5,315,366 * 5/1994 Inada et al. ..... 356/238.2
5,337,138 * 8/1994 Inada et al. ..... 356/238.2
5,359,408 * 10/1994 Inada et al. ..... 250/223 R
5,739,904 * 4/1998 Berger et al. ..... 356/238.2

* cited by examiner

*Primary Examiner*—Stephone B. Allen
(74) *Attorney, Agent, or Firm*—Jensen & Puntigam, P.S.

(57) ABSTRACT

Installation for the quality control of yarn bobbins, said installation comprising one or a plurality of quality control machines (2) which are associated to a system (5) for transporting the bobbins (7) onto supports (6), with stops for inspection purpose, said quality control machines having a housing (19) wherein are provided one or a plurality of inspection stations (11), one or a plurality of loading/unloading stations (20) and a unit for transferring the bobbins (7) from the transport system (5) to said housing (19), the bobbins being positioned successively in the stations (11, 20) and returning to the transport system (5); the unit for transferring the bobbins comprises a rotary frame (3) which makes stops of predetermined duration at each of the inspection stations (11) and loading/unloading stations (20) and incorporates various assemblies provided with a fixing member (4) intended to approach the support (6) carrying the bobbin (7) in order to take the later.

15 Claims, 4 Drawing Sheets

INSTALLATION FOR THE QUALITY CONTROL OF YARN BOBBINS

This application is a continuation in part of PCT/ES97/00317 filed Dec. 30, 1997.

FIELD OF THE INVENTION

This invention relates to the field of inspection for yarn bobbins having different nature (textile, glass fiber, etc.) to localize eventual defects which could occur when finishing said elements. More concretely, the installation according to the invention is applied for scanning yarn bobbins after their process of winding them on a core for quality control, being embodied in one or more quality control machines, each comprising one or several inspection stations as well as one or more bobbins loading/unloading areas, associated to a line to convey said factory-fresh bobbins to a use or storage area. The installation proposed is adapted for processing bobbins having different sizes, colors and material, comprising a first step of picking and transferring the bobbins from said conveying line to one or more inspection stations, where means to form (to capture and lighten ) images from the surface of the bobbin have been provided, which are thereafter duly processed with an analysis computer program applied to pick and assess possible defects and a second step of bobbin feedback to said conveying line which has due stops for such purpose.

The installation according to the invention allows to detect a great number of defects which may appear in the spinning bobbins and namely in flies, loops, flushes, scratches and strokes, spots at the bobbin end faces and sides, scratches, strokes and enlarged portions, distortions, sagging and bobbin density, color of the tube and thread of the ply, as well as rings and spots on the bobbin end faces.

BACKGROUND OF THE PATENT

Several embodiments are known in the state of the art applied to detect defects which may appear in yarn bobbins.

We can mention thus patents JP-A-62-62938 and U.S. Pat. No. 5,138,151, which disclose methods to detect by means of image forming sensors of line by line reading, installed close to light sources in a station intercalated in a transfer line of the bobbins toward a storage or service area, which is embodied in a wrapping housing which delimitates an enclosure having access doors, which is crossed by the conveying line, providing means to rotate the bobbin to a given position, within said enclosure and when the doors have been closed to darken the inspection area.

This background has the drawback that as the inspection enclosure is intercalated in the conveying line itself, the inspection operation obliges to completely stop said conveying line during a very long time, because the closure of access doors and the accurate arrangement of means to rotate a support on which the bobbin is arranged have to be provided which means the system is slow, which makes that in addition to localize a possible defect two or three shootings of the image sensor are necessary, its use additionally meaning limitations as for the bobbin color and/or material, which makes difficult the general use of the method which is useful mainly for direct reflection bobbins. In addition, as this type of sensors only reads one line, the field embraced is very limited and shootings have to be done at very close points to achieve effective results. On the other hand, this system, as the bobbin rotation means interferes with the conveying line itself, has the likelihood to lead to error in the bobbin positioning which will produce reading inaccuracy of eventual defects to be assessed. Said technical issue does not allow either to arrange several in line inspection stations because for a correct operation it will be demanded that the inspection time has same length, which is not fit for the specific nature of each inspection cycle.

Patents JP-A-07-134105 and U.S. Pat. No. 5,359,408 disclose devices to inspect spinning bobbins with inspection stations also intercalated in the conveying line, but comprising matrix camera like means to form images, the second of said backgrounds disclosing arrangements applied to detect different possible defects by using several types of light sources such as ultraviolet rays, fluorescent or others.

However, said backgrounds do not contemplate the possibility to fully scan all bobbin surfaces, carrying out an inspection of multiple and different defects which may appear in spinning bobbins, in some cases checked twice or more times and by means of one or more inspection stations mounted on one or more quality control machines associated to a factory-fresh bobbins conveying line, with the peculiarity that it is adaptable to several sizes of bobbins and regardless said bobbins color and characteristics of the material.

The installation which is disclosed is applied to implement a bobbins inspecting method and system disclosed in the international application PCT/ES 97/00070 of same applicant where a series of relative arrangements of image forming sensors and light sources are proposed in order to obtain an effect of field deepness so that they allow to accurately focus eventual defects, at each sector scanned, which significantly facilitates their identification.

DESCRIPTION OF THE INVENTION

The installation according to the invention is on the ground of the performance of a plurality of image forming sensors, several of them are movable in order to be able to locate them at predetermined points, before starting each cycle of image shooting of a related detecting operation, adapted to the type of bobbin and in general specific for each of the possible defects for which and in a preferred embodiment which will be illustrated in drawings attached, several quality control machines have been provided each of them having one or more examination/inspection stations associated to the conveying line in each of which examination/inspection stations light sources have been likewise arranged specially adapted to each case, whose arrangement, combined with a suitable optics provides an effect of field deepness sufficient in order eventual defects present in the sector are perfectly focused in the resulting image.

According to the invention, each of the quality control machines, located close to the bobbin conveying line or lines, loaded on supports, integrates a group for transferring the bobbins, applied to picking up said bobbins from said conveying line, transferring and positioning them within an enclosure which houses one or several inspection stations and further bobbins feedback to their support on the conveying line. For such purpose, one or more loading/unloading areas have been provided. Said group for bobbin transfer in turn comprises a movable frame according to discrete displacements, with stops having a predetermined time length corresponding to each of said loading/unloading stations and/or areas and on said group several assemblies are axial development angularly equally spaced arranged are provided at a free end which peripherally protrudes, from a locking member which may be linearly moved, in a to and fro motion, having a predetermined length to an approach up to the support bearing the bobbin for picking it up and further retraction during its transfer. This way said assemblies remain located successively at each of the frame stops in a position directly facing a bobbin to be examined arranged on its support on the conveying line, also temporarily stopped, while at same time one or more assemblies present a bobbin to a related inspection station or loading/unloading area.

Said displacement group, according to a preferred embodiment of the invention, comprises a dividing plate or frame having means for rotatably driving it, according to angular fractions of 360/n a complete rotation, n being the number of inspection stations plus the loading/unloading areas on the frame of which n of said assemblies are mounted, equally spaced, with an axial development fastening member, said fastening member being comprised of a collet associated to a fluid dynamic, electromechanical or mechanical cylinder, arranged at a end of said assembly, for its to and fro linear displacement and performance of grasping the bobbin winding tube.

Also means to produce a relative displacement between the bobbin and the inspection means have been provided consisting in an electric motor associated to each of said axial assemblies for picking and releasing the bobbin, which may rotatably move, in any direction possible for said fastening member from each of each of said axial development assemblies.

To best understand the invention, there is a description in details thereof below with reference to the drawings attached, and it has to be borne in mind that such drawings have a merely illustrative purpose therefore they cannot be purported at any moment as having a limitating nature.

SHORT DESCRIPTION OF THE DRAWINGS

DETAILED DESCRIPTION OF AN EXAMPLE OF EMBODIMENT

Figure 1:
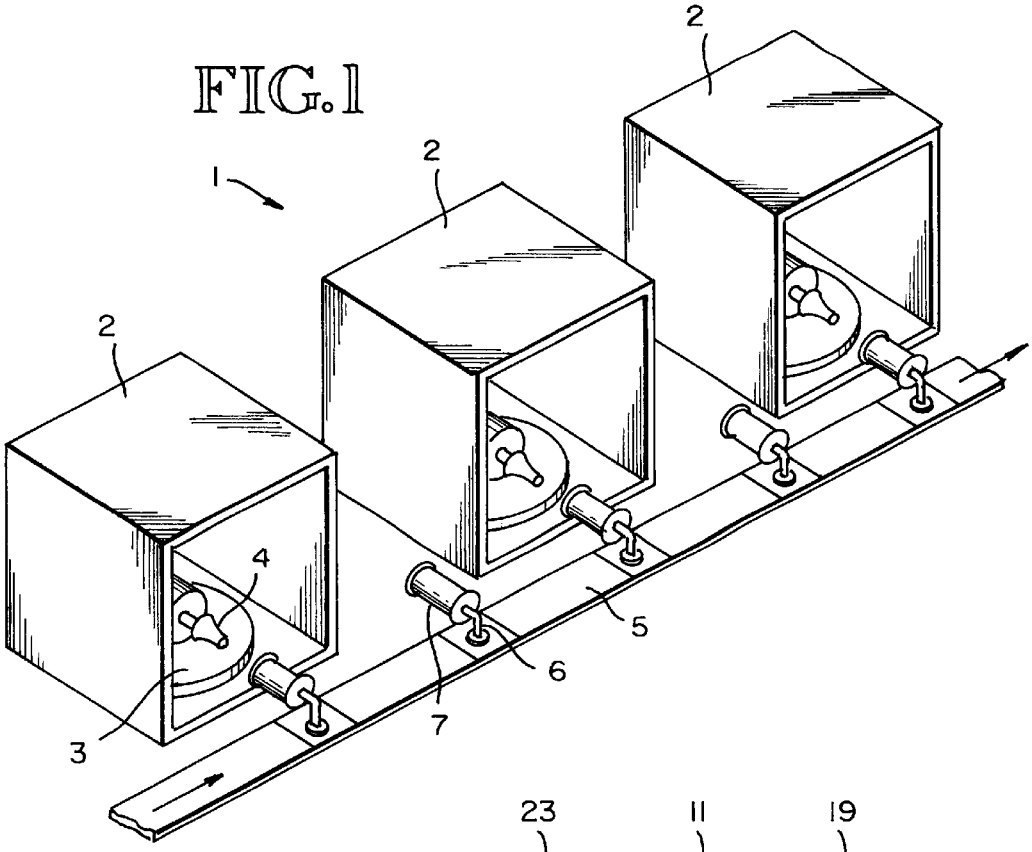
FIG. 1 shows a view in perspective of an installation according to the invention which comprises three adjacent examination stations.

FIG. 1 shows an inspection installation 1 which integrates several stand alone quality control machines 2, positioned close to each other, in order to split control tasks in several steps of inspection of a group of possible specific defects to be carried out by each of said machines 2. Each of said machines 2 is comprised of an enclosure 19 having an opening 21, which houses a rotating group 3 which acts on bobbin 7 supporting arms; a series of loading/unloading 20 and inspection 11 stations and a wrapping housing to insulate the unit from external disturbances such as light, dust, etc. The rotating group 3 is provided with at least two fastening members 4 of bobbin 7 provided with translation and rotation motion with respect to the bobbin axis, in any of the possible rotation directions. Said rotating group 3 is prepared to carry out a series of discrete stops, in its rotating motion, with related waiting times, so that each of the fastening members 4 is alternatively presented in a given position, in front of the quality control machine front opening, while the bobbins are successively positioned at said inspection stations 11.

In FIG. 1 a travelling band 5 can also be seen on which are arranged supports 6 for yarn bobbins 7 to be inspected. Each of said supports 6 has a shape and is oriented in such a way that the conveyed yarn bobbin 7 axis may be coincident with the axis of each fastening member 4 at each stop of the rotating group 3, constituted by a dividing plate or rotating frame rotatably driven according to angular fractions of 360/n of a complete rotation, n being the number of inspection stations plus the loading/unloading areas 20 of a given quality control machine 2.

Said travelling band 5 is prepared so that it has a series of discrete stops, with related waiting times, adapted to the stops of said rotating groups 3, so that each of the yarn bobbin 7, conveyed on the supports 6, remains successively coaxially facing each of related fastening members 4, in each of the quality control machines 2.

Figure 2:
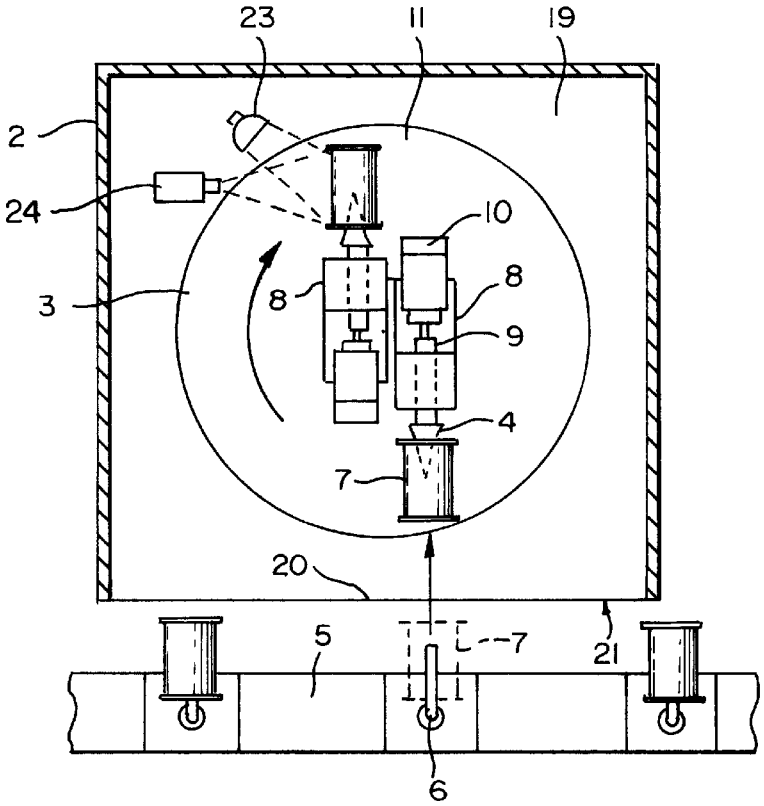
FIG. 2 shows, in a part plan view an examination station or unit of said inspection installation.

With relation to FIG. 2, there can be seen the assembly components and operation and concretely a dividing plate or equivalent device 3 on which are arranged two axial assemblies 8, ending in a related collet-shaped fastening member 4 which may be socketed and embedded within a bobbin 7 winding tube end. The orientation of said two assemblies 8, as it can be seen is 180 degrees and each of the collets is associated to a fluid dynamic cylinder or other electromechanical or mechanical device for the collet 4 to and fro linear displacement and for its driving, in addition it has been provided that the whole cylinder 9 and collet 4 assembly rotates because of the action of an electromotor 10.

By means of mentioned arrangement, and with reference to said FIG. 2, it can be seen in it how at each stop of the travelling band 5, it is proceeded to pick up a bobbin 7 from support 6 (by collet 4 linear displacement) and to transfer it by rotating the dividing plate 3 towards at least an inspection area 11, so that during the inspection, another already inspected bobbin 4 is loaded on the empty support 7.

Figure 3:
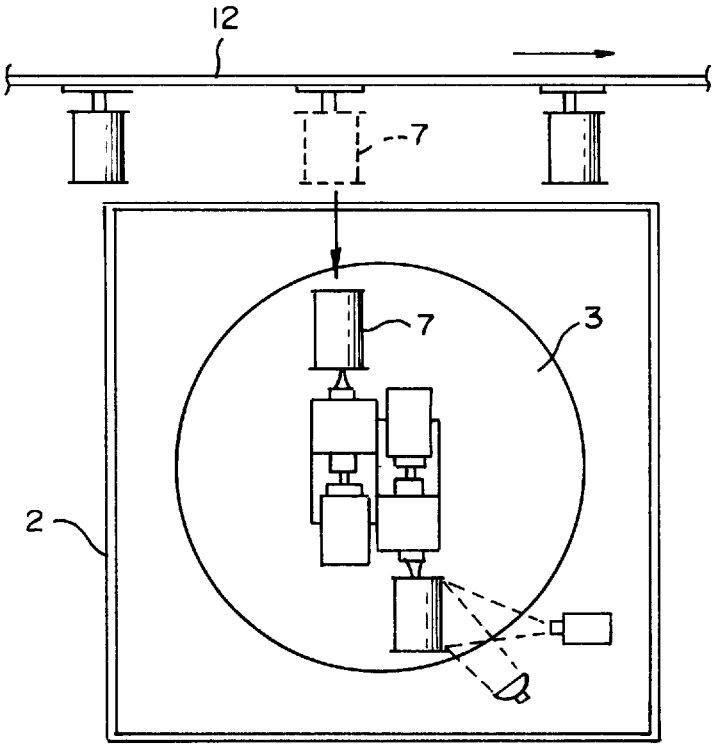
FIGS. 3 and 4 show, in elevation, variations of one of said examination units arrangement.

FIG. 3 shows the arrangement of the inspection station referring to in FIG. 2 ready to act in correspondence with bobbins 7 overhead conveying line 12, which being suspended are picked up by the fastening member or collet 4 and transferred to an inspection station 11, as above explained.

Figure 4:
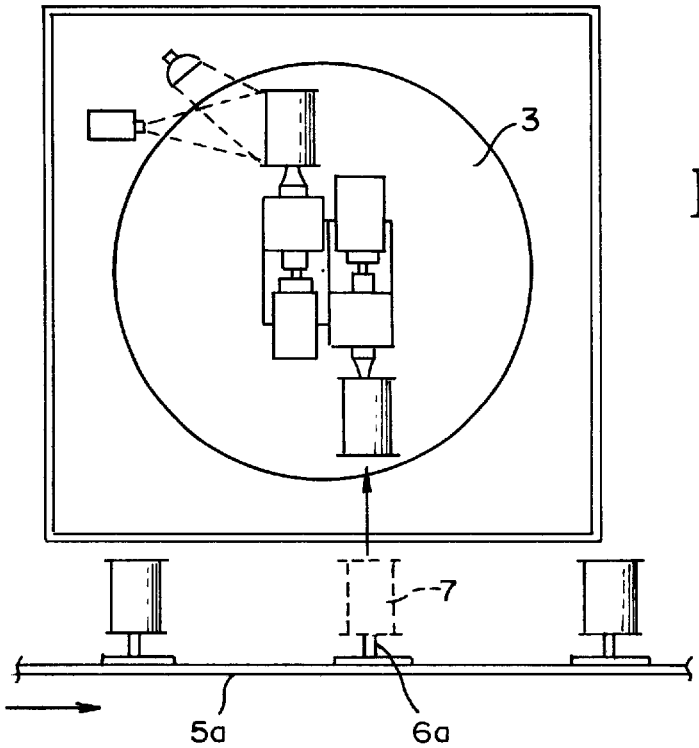

FIG. 4 shows an alternative arrangement of the inspection station 2, arranged above one or more travelling bands 5*a*, in which the bobbins are uprightly mounted, coaxial to a support 6*a*.

Figure 5:
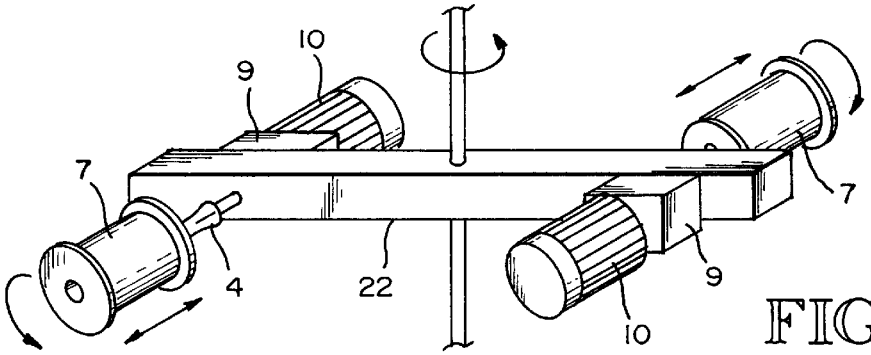
FIGS. 5, 6 and 7 show, in perspective, variations of fastening members arrangement which pertain to said examination units, the last being almost coincident with the example of FIG. 2.
Figure 6:
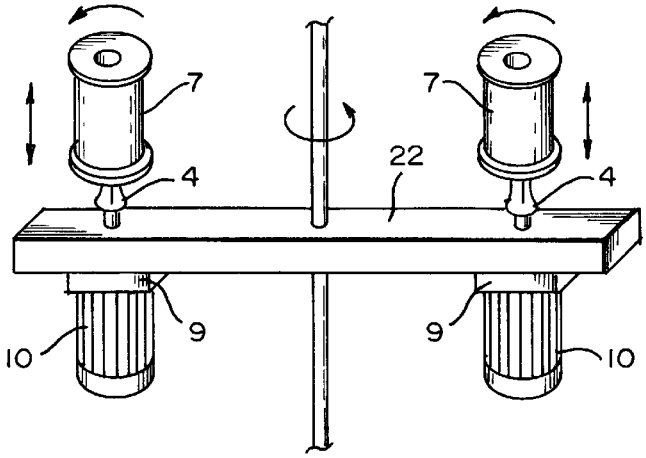
Figure 7:
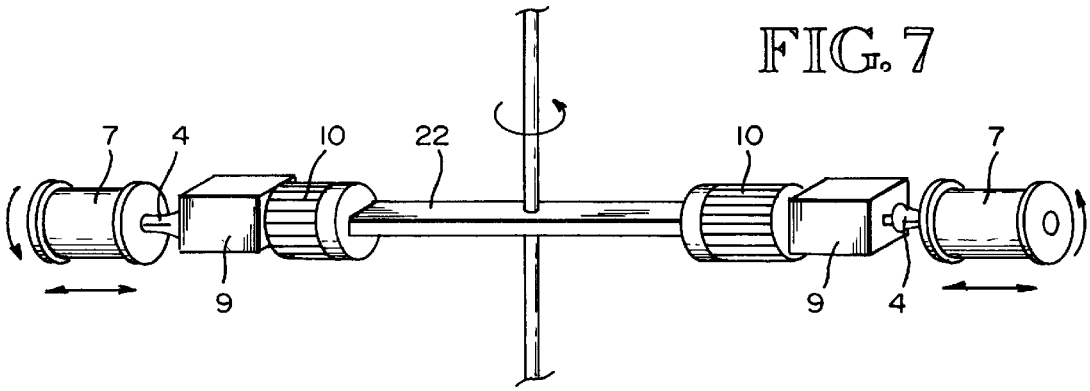
Figure 8:
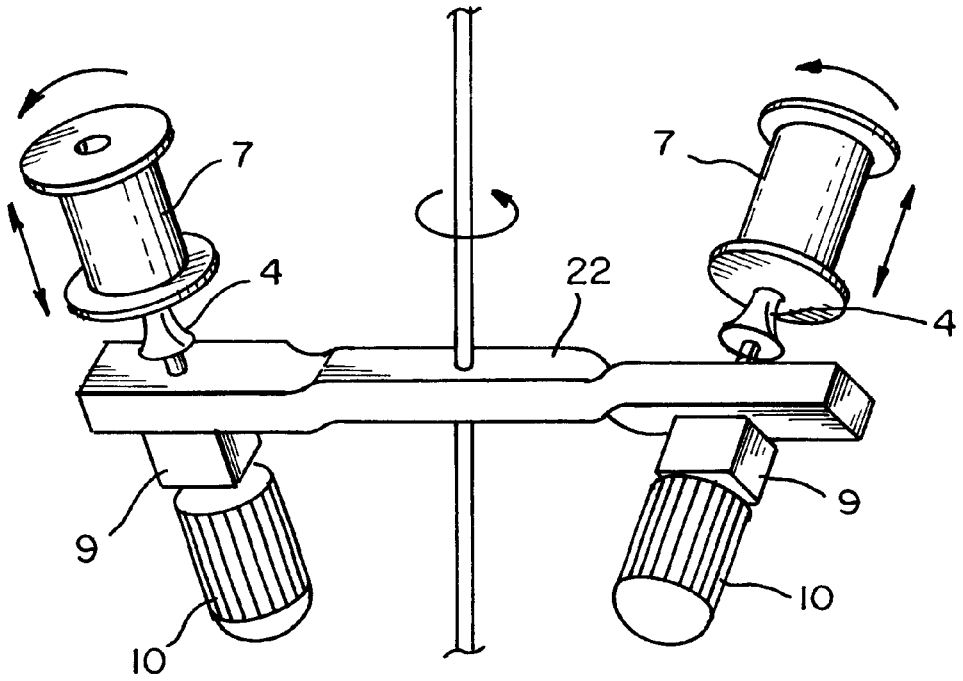
FIG. 8 depicts the titt orientation of the axial assemblies.

FIGS. 5, 6 and 7 schematically show different arrangements of bobbins fastening members and elements for their axial and rotating displacement with respect to an oblong structural element or bar rotating support 22 about an axis passing by a central point thereof. In these figures same references have been used to state already disclosed common elements.

The invention also contemplates the possibility that one or more quality control machines include an assembly of three or more angularly spaced members or arms, mounted on a rotating frame, at the end parts of which a related driving member is arranged provided with a cylinder for said member axial displacement in a linear to and fro motion, and a motor to rotate at constant speed, in any rotating direction which will act in the inspection area.

It is also considered as a possible alternative, according to the set out up to this point that the assembly of image forming sensors and light source is arranged on a support and means have been provided which may change the relative position between the bobbin to be inspected and said sensors and/or light sources which comprise a member for constant speed rotatably driving said support.

We claim:

1. Installation for quality control of yarn bobbins of the type including:

a conveying line (5) having supports (6) arranged thereon to carry bobbins (7); and at least one quality control machine (2) associated to said conveying line (5), said conveying line (5) having stops at said quality control machine (2) to carry out inspection operations of said bobbins (7);

said quality control machine (2) comprising:

an enclosure (19) housing:

at least one area (20);

at least one inspection station (11) having one or more light sources (23) and one or more image forming sensors (24);

at least one holder for the bobbin (7) to be examined;

transfer means to transfer a bobbin (7) from said supports (6) on said conveying line (5) to said holder in the quality control machine (2) and to return the inspected bobbin (7) from the holder to an empty support (6) on said conveying line (5);

a shifting device for shifting said holder between said at least one area (20) and said at least one inspection station (11); and means to change the relative position between the bobbin (7) on said holder and said light sources and/or image forming sensors (23, 24) in said at least one inspection station (11);

wherein said at least one holder for the bobbin (7) to be examined comprises:

an outwardly facing bobbin fastening member (4); and a moving device coupled to said fastening member (4) for linear displacement thereof a predetermined length so as to convey a bobbin (7) to and from one of the supports (6) on the conveying line (5), said moving device constituting said transfer means, said at least one fastening member (4) and moving device being integrated in at least one assembly (8) associated to said shifting device in the quality control machine (2).

2. Installation, according to claim 1, wherein said means to change the relative position between the bobbin (7) on said collet (4) and said light sources or image forming sensors (23, 24) comprise a movable support to which said light sources or image forming sensors (23, 24) are attached, and a constant rate driving device connected to said support to move light sources or image forming sensors (23, 24) around the bobbin (7) at the at least one inspection station (11).

3. Installation according to claim 1, wherein said enclosure (19) of the quality control machine (2) is located above the conveying line comprising one or several travelling bands **(5*a*) with a series of supports (6*a*) bearing bobbins (7)** attached thereon.

4. Installation, according to claim 1, wherein bobbins (7) are conveyed suspended by an overhead conveying line (12) and wherein the enclosure (19) of the quality control machine (2) is located under said conveying line (12).

5. Installation, according to claim 1, wherein it comprises several of said quality control machines (2) close to each other, each of them being arranged for detecting one or more possible predetermined specific defects, so that scanning in the whole inspection operations is divided.

6. Installation, according to claim 1, wherein said device for shifting said fastening member between said at least one area (20) and said at least one inspection station (11) comprises a structural element (22) driven to rotate about a central axis and provided, close to its ends, with respective assemblies (8) having respective fastening members (4) connected to respective devices (9) for linear displacement thereof mutually parallel in opposed directions in a plane perpendicular to said rotation central axis, said devices (9) being in turn connected to respective driving devices (10) to rotate said fastening members (4) about the axis of respective bobbins (7) grasped thereon, at a constant rate.

7. Installation, according to claim 1, wherein said device for shifting said fastening member between said at least one area (20) and said at least one inspection station (11) comprises a structural element (22) driven to rotate about a central axis and provided, close to its ends, with respective assemblies (8) having respective fastening members (4) connected to respective devices (9) for linear displacement thereof in a same direction parallel to said rotation central axis, said devices (9) being in turn connected to respective driving devices (10) to rotate said fastening members (4) about the axis of respective bobbins (7) grasped thereon, at a constant rate.

8. Installation, according to claim 1, wherein said device for shifting said fastening member between said at least one area (20) and said at least one inspection station (11) comprises an structural element (22) driven to rotate about a central axis and provided, close to its ends, with respective assemblies (8) having respective fastening members (4) connected to devices (9) for linear displacement thereof in opposite directions mutually aligned about a centerline perpendicularly crossing said rotation central axis, said devices (9) being in turn connected to respective driving devices (10) to rotate said fastening members (4) about axis of respective bobbins (7) grasped thereon, at a constant rate.

9. Installation, according to claim 1, wherein said fastening member (4) comprises a collet actuated by a device (9) for grasping the winding tube of the bobbin (7), said device (9) also driving said linear displacement of the fastening member (4).

10. Installation, according to claim 9, wherein the said collet (4) is provided to be inserted in said bobbin winding tube for securement.

11. Installation, according to claim 1, wherein said means to change the relative position between the bobbin (7) and said light sources and image forming sensors (23, 24) comprise an electric motor (10) integrated to said at least one assembly (8) and coupled to an axial shaft of said fastening member (4) to rotate said fastening member (4) with a bobbin (7) grasped thereon at a constant rate in any of the two rotation directions at the at least one inspection station (11).

12. Installation, according to claim 11, wherein said enclosure (19) is delimited by an enclosure having at least one opening (21) facing said at least one area (20) and close to said conveying line (5), the at least one inspection station (11) being arranged within said enclosure (19) away from said at least one opening (21), through which loading and unloading of the bobbins (7) is carried out by the assemblies (8).

13. Installation, according to claim 11, wherein said device for shifting said holder between said at least one area (20) and said at least one inspection station (11) comprises a frame (3) rotatable about an axis with said at least one assembly (8) fixed thereon.

14. Installation, according to claim 13, wherein several of said assemblies (8) are fixed on said frame (3) at equal angular intervals around said axis, the number of assemblies (8) being equal to the number of inspection stations (11) plus the number of areas (20) also disposed at equal angular intervals around said frame (3), a rotating device being coupled to frame (3) to move said assemblies (8) with discrete angular displacements according to said equal angular intervals with stops of a predetermined duration of each assembly (8) at each inspection station (11) and area (20).

15. Installation, according to claim 14, wherein there are two of said assemblies (8) on said frame (3) arranged juxtaposed on a plane perpendicular to said rotation axis and mutually parallel close to both sides of said axis or diametrically aligned with the same.

* * * * *